US010894434B2

(12) United States Patent
Yamamoto

(10) Patent No.: US 10,894,434 B2
(45) Date of Patent: Jan. 19, 2021

(54) LIFE COUNTER MANAGEMENT SYSTEM

(71) Applicant: KYOCERA Document Solutions Inc., Osaka (JP)

(72) Inventor: Takenori Yamamoto, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 16/415,966

(22) Filed: May 17, 2019

(65) Prior Publication Data

US 2019/0358976 A1 Nov. 28, 2019

(30) Foreign Application Priority Data

May 22, 2018 (JP) ..... 2018-098343

(51) Int. Cl.
*B41J 29/38* (2006.01)

(52) U.S. Cl.
CPC ..... *B41J 29/38* (2013.01)

(58) Field of Classification Search
CPC ..... B41J 29/393; B41J 2/17546; B41J 2/175; B41J 29/38; B41J 2/1752
See application file for complete search history.

(56) References Cited

FOREIGN PATENT DOCUMENTS

JP 3127923 B2 * 1/2001 ..... G03G 15/00
JP 2001-125442 5/2001

* cited by examiner

*Primary Examiner* — Jannelle M Lebron

(57) ABSTRACT

When a replaceable unit is mounted to a main body, if a main body identifier reference value stored in a local memory of the replaceable unit is different from the main body identifier, the main body rewrites the main body identifier reference value, writes a life counter value stored in the main body memory into the local memory as a master counter reference value, and writes a life counter value stored in the local memory separately into the local memory as a life counter reference value. The main body increments the life counter values due to an action, and determines a life count value of the replaceable unit on the basis of a difference between the life counter value in the main body memory and the master counter reference value and a difference between the life counter value in the local memory and the life counter reference value.

4 Claims, 11 Drawing Sheets

LIFE COUNTER MANAGEMENT SYSTEM

CROSS-REFERENCE TO RELATED APPLICATIONS

This application relates to and claims priority rights from Japanese Patent Application No. 2018-098343, filed on May 22, 2018, the entire disclosures of which are hereby incorporated by reference herein.

BACKGROUND

1. Field of the Present Disclosure

The present disclosure relates to a life counter management system.

2. Description of the Related Art

In an system, (a) a first rewritable non-volatile memory is arranged in a replaceable unit capable of being mounted to and demounted from a main body of an apparatus, and a second rewritable non-volatile memory is arranged in the main body; (b) a life counter value such as total operating time length of this apparatus is stored in the second non-volatile memory; (c) the current life counter value of the main body is written into the first non-volatile memory only once when the replaceable unit is mounted; and (d) if a difference between the life counter value in the second non-volatile memory and the life counter value in the first non-volatile memory (i.e. a value counted up from a time point of mounting the replaceable unit) gets equal to or larger than a predetermined threshold value, then a replacement request of the replaceable unit is issued. Further, in this system, a flag is set in the first non-volatile memory in the replaceable unit, and only if the flag has an initial value, the life counter value is written into the first non-volatile memory when the replaceable unit is mounted, and afterward the flag is changed to another value and thereby rewriting the life counter value in the first non-volatile memory is prohibited.

In the aforementioned system, as the aforementioned difference, the life count value of the replaceable unit is determined and is written into the first non-volatile memory only once (i.e. when mounted), and therefore, the number of times of writing into the first volatile memory, that is required for the management of the life count value of the replaceable unit, does not exceed a writing upper limit times of the first non-volatile memory.

However, in the aforementioned system, if a replaceable unit that has been mounted to a main body of an original apparatus and has been used is demounted from the main body of this apparatus and thereafter mounted to a main body of another apparatus, then this another apparatus hardly performs proper management of the life count value of this replaceable unit on the basis of the aforementioned difference because the original apparatus and this another apparatus have different life counter values in the respective main bodies.

SUMMARY

A life counter management system according to an aspect of the present disclosure includes a main body of each apparatus among plural apparatuses, and a replaceable unit capable of being mounted to and demounted from the main body. The main body includes a main body memory that is a non-volatile memory, and a life counter managing unit. The replaceable unit includes a local memory that is a non-volatile memory. Further, (a) when the replaceable unit is mounted to the main body, if a main body identifier reference value stored in the local memory of the replaceable unit is different from a main body identifier of the main body that the replaceable unit is mounted, the life counter managing unit (a1) writes the main body identifier of the main body into the local memory of the replaceable unit as the main body identifier reference value, (a2) writes a life counter value stored in the main body memory of the main body into the local memory as a master counter reference value, and (a3) writes a life counter value stored in the local memory separately into the local memory as a life counter reference value; (b) the life counter managing unit counts up an action of the main body and increments a life counter value in the main body memory in accordance with the action; (c) the life counter managing unit increments a life counter value in the local memory in accordance with the action of the main body; and (d) the life counter managing unit determines a life count value of the replaceable unit on the basis of (d1) a first difference between the current life counter value in the main body memory and the master counter reference value and (d2) a second difference between the current life counter value in the local memory and the life counter reference value.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
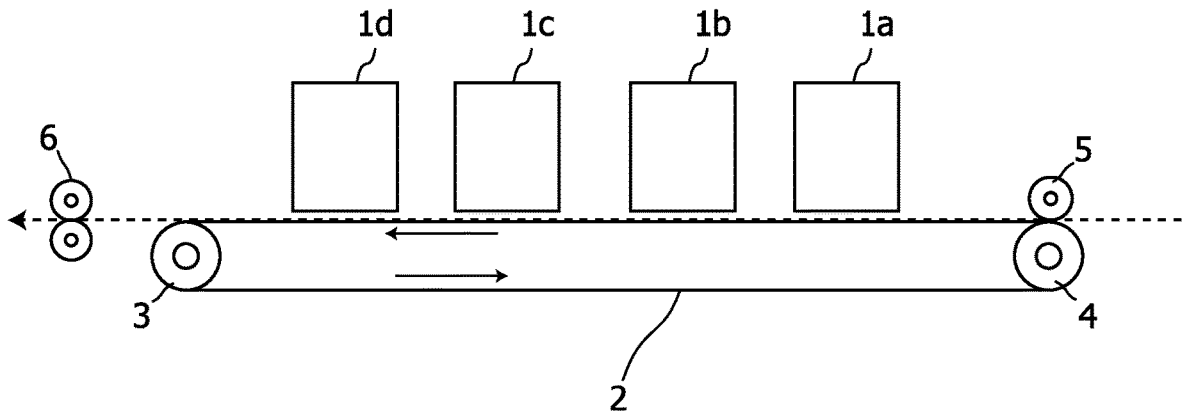
FIG. 1 shows a side view that indicates an internal mechanical configuration of an inkjet image forming apparatus to which a life counter management system in an embodiment according to the present disclosure is applied.
Figure 2:
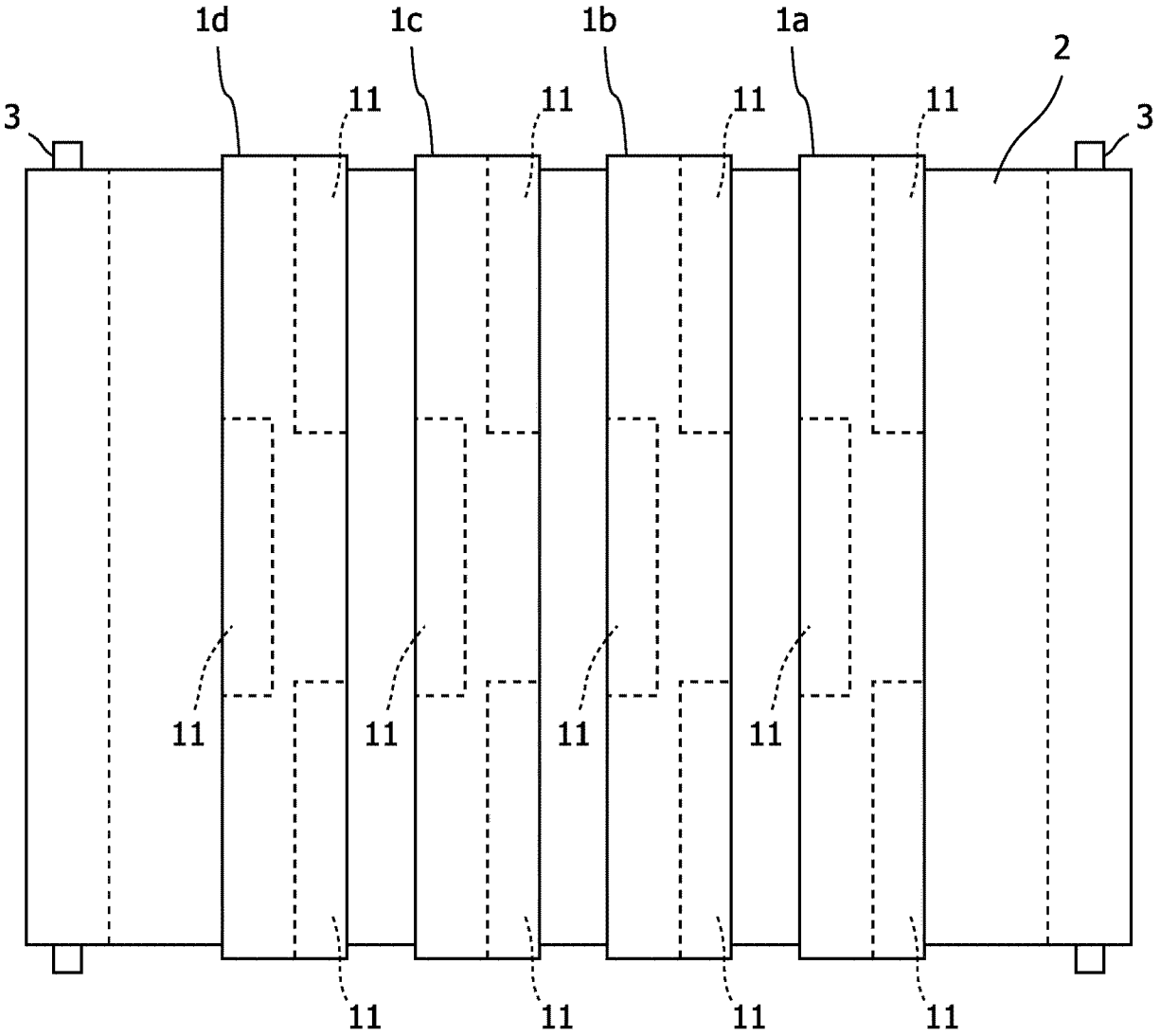
FIG. 2 shows a plane view of the image forming apparatus shown in FIG. 1.

FIG. 1 shows a side view that indicates an internal mechanical configuration of an inkjet image forming apparatus to which a life counter management system in an embodiment according to the present disclosure is applied. FIG. 2 shows a plane view of the image forming apparatus shown in FIG. 1. In this embodiment, each inkjet image forming apparatus includes a head module as a replaceable unit capable of being mounted to and demounted from a main body thereof.

The image forming apparatus in this embodiment is an apparatus such as printer, copier, facsimile machine or multi function peripheral, and has a line-type inkjet color printing mechanism.

The image forming apparatus shown in FIG. 1 includes (a) line-type inkjet recording units 1*a* to 1*d* corresponding to ink colors of Cyan, Magenta, Yellow and Black, (b) a circular-type transportation belt 2 that transports a printing paper sheet, (c) a driving roller 3 and a driven roller 4 around which the transportation belt 2 is hitched, (d) a nipping roller 5 that nips the printing paper sheet with the transportation belt 2, and (e) an output roller pair 6.

The driving roller 3 and the driven roller 4 rotates the transportation belt 2. The nipping roller 5 nips an incoming printing paper sheet transported by a transportation system (not shown) from a sheet tray or the like. The nipped printing paper sheet is transported by the transportation belt 2 to printing positions of the inkjet recording units 1*a* to 1*d* in turn, and on the printing paper sheet, images of respective colors are printed by the inkjet recording units 1*a* to 1*d*. Subsequently, after the color printing, the printing paper sheet is outputted by the output roller pair 6 to an output tray (not shown) or the like.

Further, as shown in FIG. 2, in this embodiment, each inkjet recording unit 1*a*, 1*b*, 1*c* or 1*d* includes plural (here, three) head modules 11-1 to 11-N. The head modules 11-1 to 11-N are arranged along a primary scanning direction, and are capable of being mounted to and demounted from a main body of the image forming apparatus. Thus, each head module 11-*i* (i=1, . . . , N) is replaceable with a new head module or a used head module (i.e. a head module of which use has been started). Each inkjet recording unit 1*a*, 1*b*, 1*c* or 1*d* may include only one head module 11-*i*.

Figure 3:
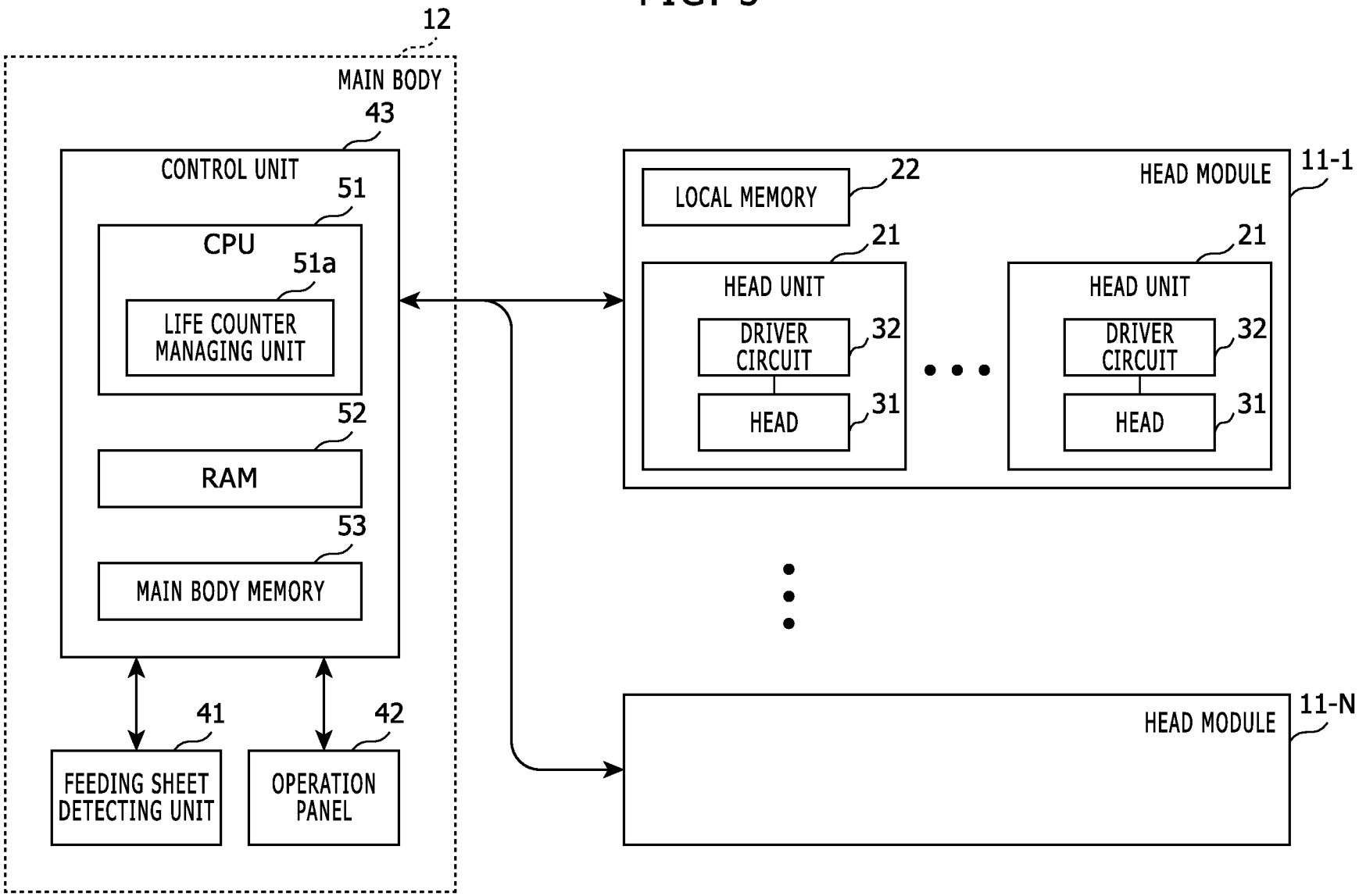
FIG. 3 shows a block diagram that indicates a configuration of the life counter management system in an embodiment according to the present disclosure.

FIG. 3 shows a block diagram that indicates a configuration of the life counter management system in an embodiment according to the present disclosure. As shown in FIG. 3, each head unit 11-*i* includes plural (here, four) head units 21. Therefore, here, twelve head units 21 are installed for each inkjet recording unit 1*a*, 1*b*, 1*c* or 1*d* (i.e. for each color).

The head unit 21 includes a head 31 and a driver circuit 32. The head 31 includes (a) a nozzle that ejects ink and (b) a piezoelectric element that causes the nozzle to eject ink in accordance with a driving voltage. An ink tank (not shown) is connected to the head 31, and ink is supplied from the ink tank to the head 31. The driver circuit 32 is a circuit that applies the driving voltage to the piezoelectric element of the head 31 and thereby causes the head 31 to eject ink.

Further, each head module 11-*i* includes a local memory 22. The local memory 22 is a rewritable non-volatile memory such as flash memory. For example, a non-volatile memory used as the local memory 22 is a 256-byte NAND type flash memory of which the writing upper limit times is about one million times.

In the local memory 22, data is stored for management of a life count value of this head module 11-*i*. The life count value is a count value that indicates total action times, total operating time length or the like (here, the number of printed pages) of this head module 11-*i* from an initial state to a current time point. Further, in the local memory 22, other data (property data of the head module 11-*i* or the like) may be stored than the data for management of the life count value, or such other data may not be stored.

Meanwhile, the main body 12 includes a mechanical configuration shown in FIGS. 1 and 2 (except for the head modules 11-1 to 11-N) and also includes a feeding sheet detecting unit 41, an operation panel 42, and a control unit 43.

The feeding sheet detecting unit 41 detects a printing paper sheet that passes at a predetermined position in a transportation path of the printing paper sheet (for example, in a previous or next stage of the inkjet recording units 1*a* to 1*d*). The feeding sheet detecting unit 41 detects the incoming printing paper sheet using an optical sensor, for example.

The operation panel 42 is arranged on a housing surface of the man body 12, and includes a display device such as a liquid crystal display and an input device such as a hard key and/or touch panel, and displays sorts of messages for a user using the display device and receives a user operation using the input device.

The control unit 43 is installed for and electrically connected to the head modules 11-1 to 11-N. The control unit 43 controls each head module 11-*i* for a printing action and performs management of the life count value of each head module 11-*i*.

The control unit 43 includes a computer that includes a CPU (Central Processing Unit) 51, a RAM (Random Access Memory) 52, a main body memory 53 and the like.

The CPU 51 executes a program loaded from the main body memory 53, a ROM (Read Only Memory) (not shown) or the like to the RAM 52, and thereby acts as sorts of processing units. The main body memory 53 is a rewritable non-volatile memory such as flash memory and has a larger capacity than the local memory 22.

Here, the CPU 51 acts as a life counter managing unit 51*a*. (a) When the head module 11-*i* is mounted to the main body 12, if a main body identifier (i.e. unique data to this apparatus, such as serial number) stored in the local memory 22 of the head module 11-*i* is different from a main body identifier of the main body 12 that the head module 11-*i* is mounted, the life counter managing unit 51*a* (a1) writes the main body identifier of the main body 12 into the local memory 22 of the head module 11-*i*, (a2) writes a life counter value (a life count value of this main body 12) stored in the main body memory 53 of the main body 12 into the local memory 22 as a master counter reference value, and (a3) writes a life counter value stored in the local memory separately into the local memory 22 as a life counter reference value; (b) the life counter managing unit 51*a* counts up an action of the main body 12 and increments a life counter value in the main body memory 53 in accordance with the action; (c) the life counter managing unit 51*a* increments a life counter value in the local memory 22 in accordance with the action of the main body; and (d) the life counter managing unit 51*a* determines a life count value of the head module 11-*i* on the basis of (d1) a first difference between the current life counter value in the main body memory 53 and the master counter reference value in the local memory 22 and (d2) a second difference between the current life counter value in the local memory 22 and the life counter reference value.

Consequently, the aforementioned first difference indicates a count value in an apparatus (a main body) that this head module 11-*i* is mounted, and the aforementioned second difference indicates a count value in an apparatus (a main body) that this head module 1-*i* was mounted in the past, and therefore, the life count value of this head module 11-*i* is determined on the basis of the aforementioned first and second differences.

Specifically, in this embodiment, the life counter managing unit 51*a* (b) increments the life counter value in the main body memory 53 by 1 for one time of a predetermined action (here, printing one page) of the main body 12, (c) increments the life counter value in the local memory 22 by 1 for predetermined plural times of the predetermined action (e.g. printing 100 pages), and (d) determines the life count value of the head module 11-*i* on the basis of a sum of (d1) the first difference and (d2) a product of the second difference and the predetermined plural times.

In a printing action, when one printing paper sheet is detected by the feeding sheet detecting unit 41, the life counter managing unit 51*a* determines that printing of one page is performed.

Consequently, a small size of a memory area is sufficient for storing the life counter value in the local memory 22, and rewriting times (i.e. rewriting frequency) of the life counter value gets small in the local memory 22.

Further, in this embodiment, if the life counter managing unit 51*a* receives a zero clear request for a specific head module 11-*i*, then the life counter managing unit 51*a* (a) writes the life counter value stored in the main body memory 53 into the local memory 22 as the master counter reference value, and (b) resets the life counter reference value stored in the local memory 22 of this head module 11-*i* as zero.

The following part explains a behavior of the life counter management system of this embodiment.

(a) When Starting Operation in an Initial State of the Apparatus

Figure 4:
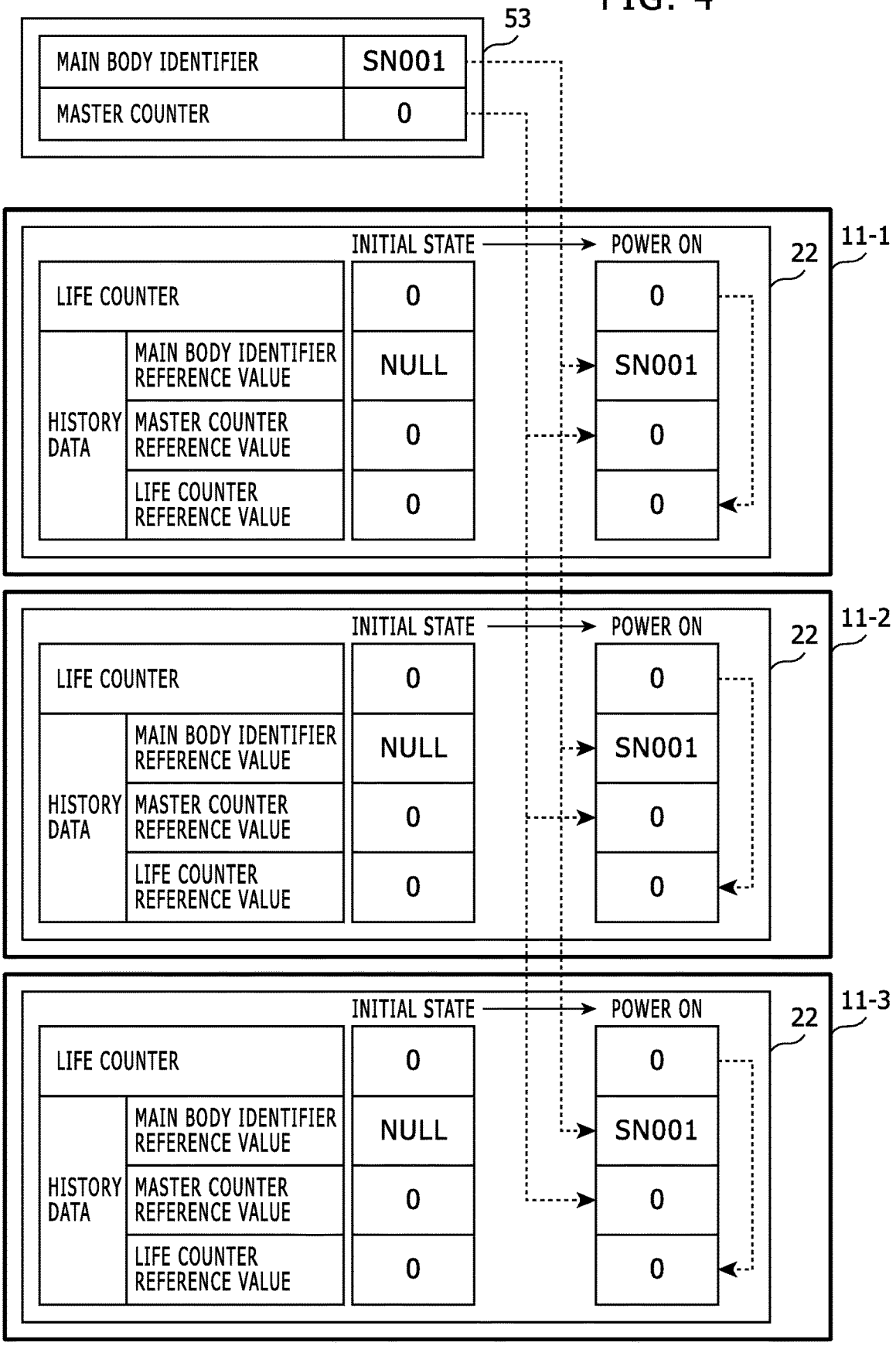
FIG. 4 shows a diagram that explains a behavior of the life counter management system shown in FIG. 3 at a time point that the apparatus starts operation in an initial state.

This part explains a behavior of the life counter management system of this embodiment when starting operation in an initial state (for example, after factory shipment of the apparatus). FIG. 4 shows a diagram that explains a behavior of the life counter management system shown in FIG. 3 at a time point that the apparatus starts operation in an initial state. In FIG. 4, the number N of the head module 11-1 to 11-N is set as three for simple explanation, but is not limited.

As shown in FIG. 4, in the main body memory 53 of the main body 12, a memory area is allocated for (a) the main body identifier and (b) a count value of a master counter (i.e. a counter for the life count value of the main body 12), and in this memory area, the main body identifier and the count value of the master counter are stored.

Further, as shown in FIG. 4, in the local memory 22 of each head module 11-*i*, a memory area is allocated for a count value of the life counter (i.e. a counter for the life count value of this head module 11-*i*) and history data, and in this memory area, the count value of the life counter and the history data are stored. Here, the history data consists of at least the main body identifier reference value, the master counter reference value, and the life counter reference value.

The main body identifier reference value indicates a main body identifier of the main body 12 (or the apparatus) to which this head module 11-*i* is currently mounted. The master counter reference value and the life counter reference value indicate a count value of the master counter and a count value of the life counter at a time point that this head module 11-*i* is mounted to the main body 12.

Therefore, due to an action (here, printing) as a target of the life count, a count value of the master counter and a count value of the life counter are incremented, but the master counter reference value and the life counter reference value are not renewed due to the aforementioned action although renewed at the mounting.

In addition, in an initial state (i.e. a state that usage has not been started), (a) the count values of the master counter and the life counter are set as zero, (b) the main body identifier as property data is set as a value that is not identical to a main body identifier of any apparatuses (here, NULL), and (c) the master counter reference value and the local counter reference value as property data are set as zero.

When the main body 12 is powered on in this state, the control unit 43 starts an initialization action, and thereby the life counter managing unit 51*a* firstly reads the main body identifier reference value in the local memory 22 of each head module 11-*i* and the main body identifier in the main body memory 53, and determines whether both are identical to each other or not.

When the initialization action is performed in an initial state, the main body identifier reference value stored in each head module 11-*i* does not agree with the main body identifier of the main body 12 because the main body identifier reference value is initially set as NULL.

Therefore, the life counter managing unit 51*a* determines that both are not identical to each other, and as shown in FIG. 4, reads a current count value of the master counter and renews the main body identifier reference value and the master counter reference value stored in the local memory 22 of the head module 11-*i* with the main body identifier stored in the main body memory 53 and the current count value of the master counter, respectively.

Figure 5:
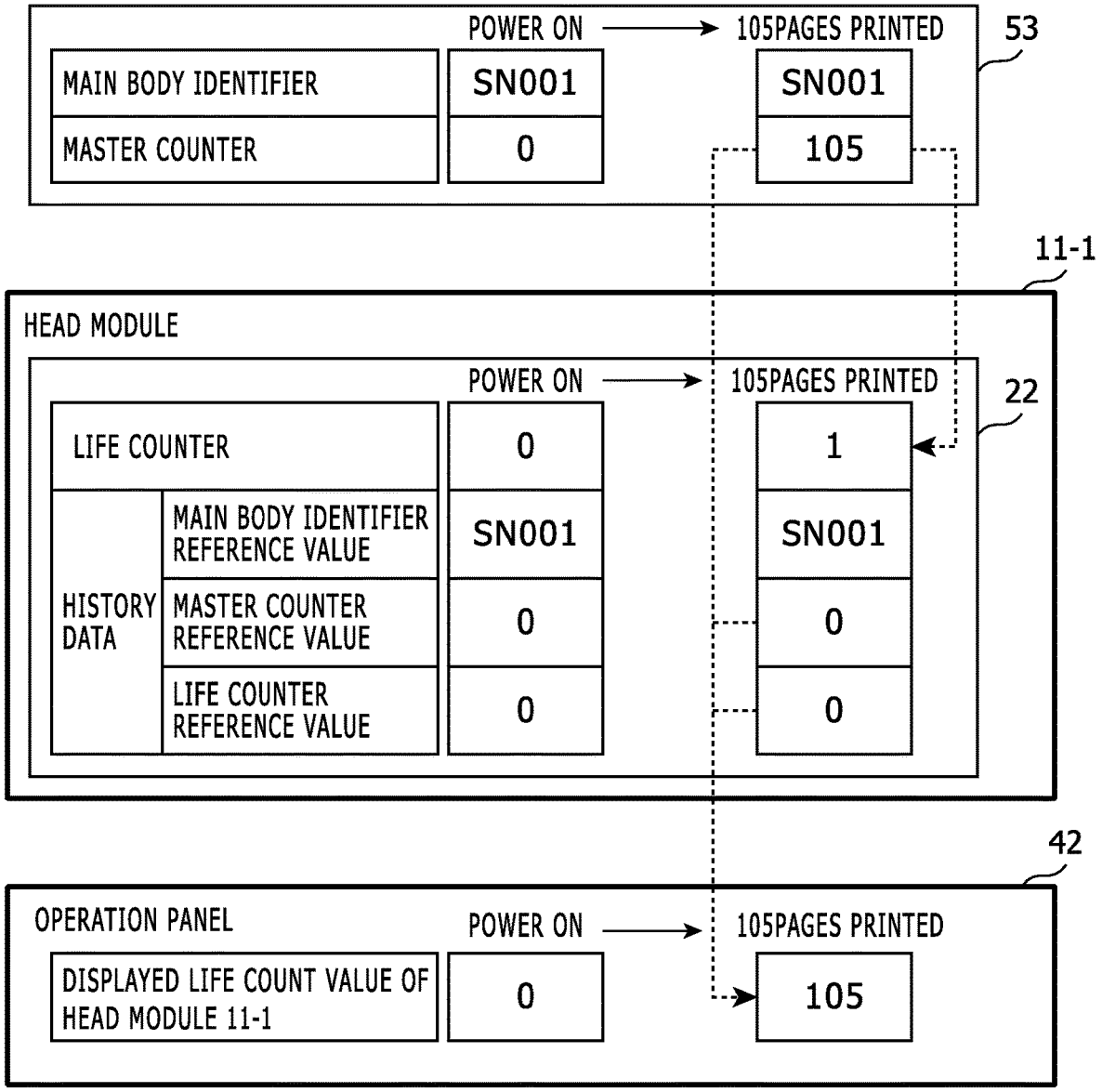
FIG. 5 shows a diagram that explains a behavior of the life counter management system shown in FIG. 3 when the apparatus performs a predetermined number of times of actions (1/2)
Figure 6:
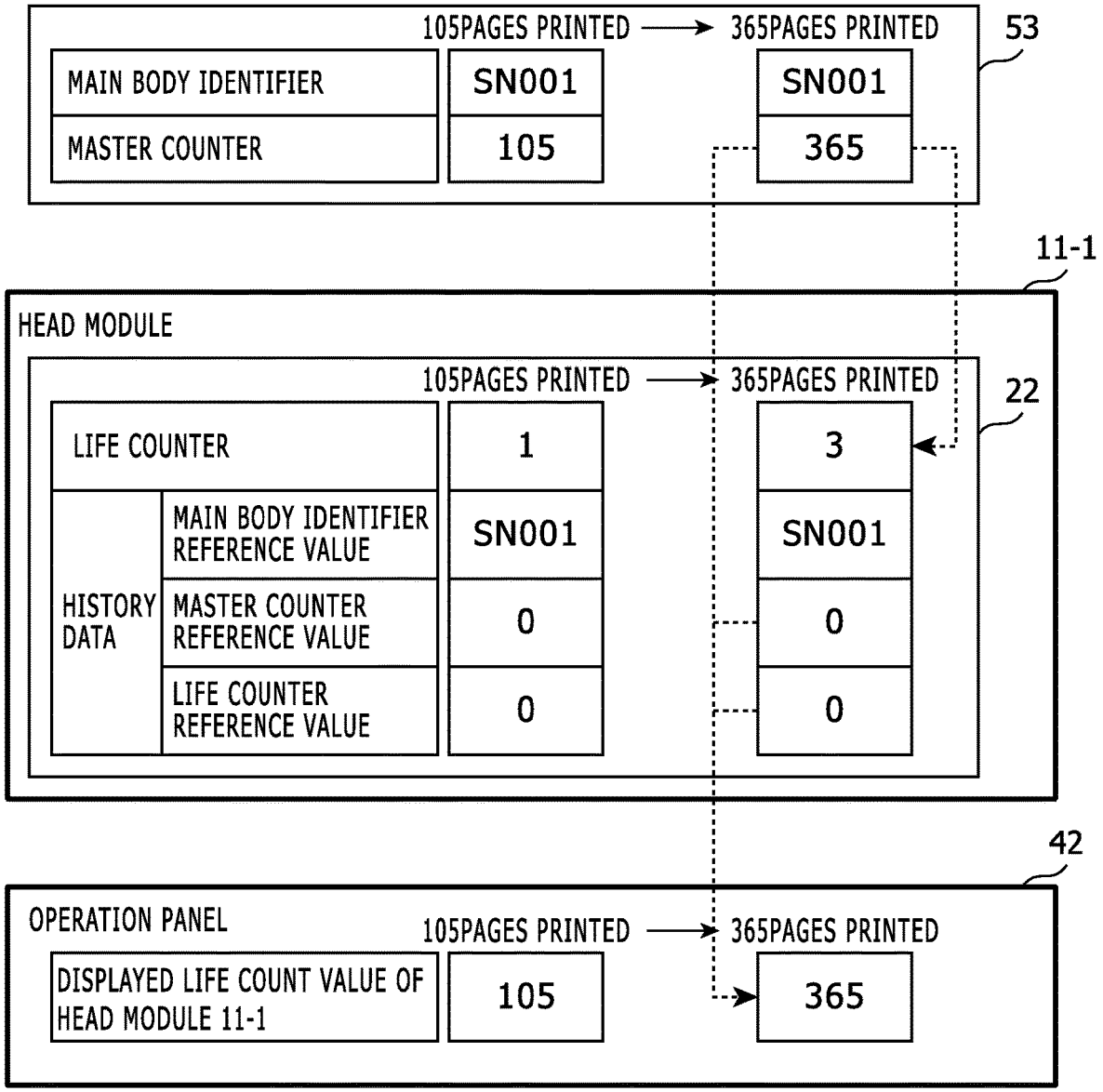
FIG. 6 shows a diagram that explains a behavior of the life counter management system shown in FIG. 3 when the apparatus performs a predetermined number of times of actions (2/2)

(b) When a Target Action for the Life Count is Repeatedly Performed after the Initial State with No Replacement of the Head Modules 11-1 to 11-N This part explains a behavior of the life counter management system of this embodiment when printing is repeatedly performed after the initial state with no replacement of the head modules 11-1 to 11-N. FIG. 5 shows a diagram that explains a behavior of the life counter management system shown in FIG. 3 when the apparatus performs a predetermined number of times of actions (1/2). FIG. 6 shows a diagram that explains a behavior of the life counter management system shown in FIG. 3 when the apparatus performs a predetermined number of times of actions (2/2).

Every time that printing of one page is performed, the life counter managing unit 51*a* increments a count value of the master counter by 1, and derives a life counter executed value CN1 of the head module 11-*i* in accordance with Formula (1).

$$CN1 = \text{rounddown}((CN\text{master} - CN\text{master_ref})/Nc) + CN\text{life_ref} \quad (1)$$

Here, rounddown ( ) is a function that rounds down after the decimal, CNmaster is the current count value of the master counter, CNmaster_ref is the master counter reference value, CNlife_ref is a life counter reference value, and Nc is a constant that indicates a frequency of incrementation. For example, when Nc=100, a count value of the life counter is incremented by 1 for printing of every 100 pages.

Subsequently, if the life counter executed value CN1 is different from a count value of the life counter stored in the local memory 22, then the life counter managing unit 51*a* renews the count value of the life counter in the local memory 22 with the life counter executed value CN1 (i.e. increments the count value). Thus, if the life counter executed value CN1 is equal to a count value of the life counter stored in the local memory 22, then the life counter executed value CN1 is not written into the local memory 22, and i the life counter executed value CN1 is different from a count value of the life counter stored in the local memory 22, then the life counter executed value CN1 is written into the local memory 22.

Further, the life counter managing unit 51*a* derives a current displayed life count value CN(i) of each head module 11-*i* in accordance with Formula (2), and displays the displayed life count value CN(i) on the operation panel 42.

$$CN(i)=(CN\text{master}-CN\text{master_ref})+CN\text{life_ref}*Nc \quad (2)$$

For example, as shown in FIG. 5, when printing of 105 pages is performed after the initial state, at this time point, a counter value of the life counter is 1 based on Formula (1) (here, Nc=100), and the displayed life count value of the head module 11-*i* is 105 based on Formula (2) (here, Nc=100).

Afterward, when printing of 260 pages is additionally performed, namely printing of 365 pages is performed after the initial state, as shown in FIG. 6, at this time point, a counter value of the life counter is 3 based on Formula (1) (here, Nc=100), and the displayed life count value of the head module 11-*i* is 365 based on Formula (2) (here, Nc=100).

In such a case, for example, even if the power supply of the main body 12 is cut off upon printing of a specific pages and then the main body 12 is powered on and performs printing, the life counter managing unit 51*a* does not renew the history data (the main body identifier reference value, the master counter reference value, and the life counter reference value) in the local memory 22 when powered on because the main body identifier reference value in the local memory 22 and the main body identifier of the main body 12 agree with each other.

Figure 7:
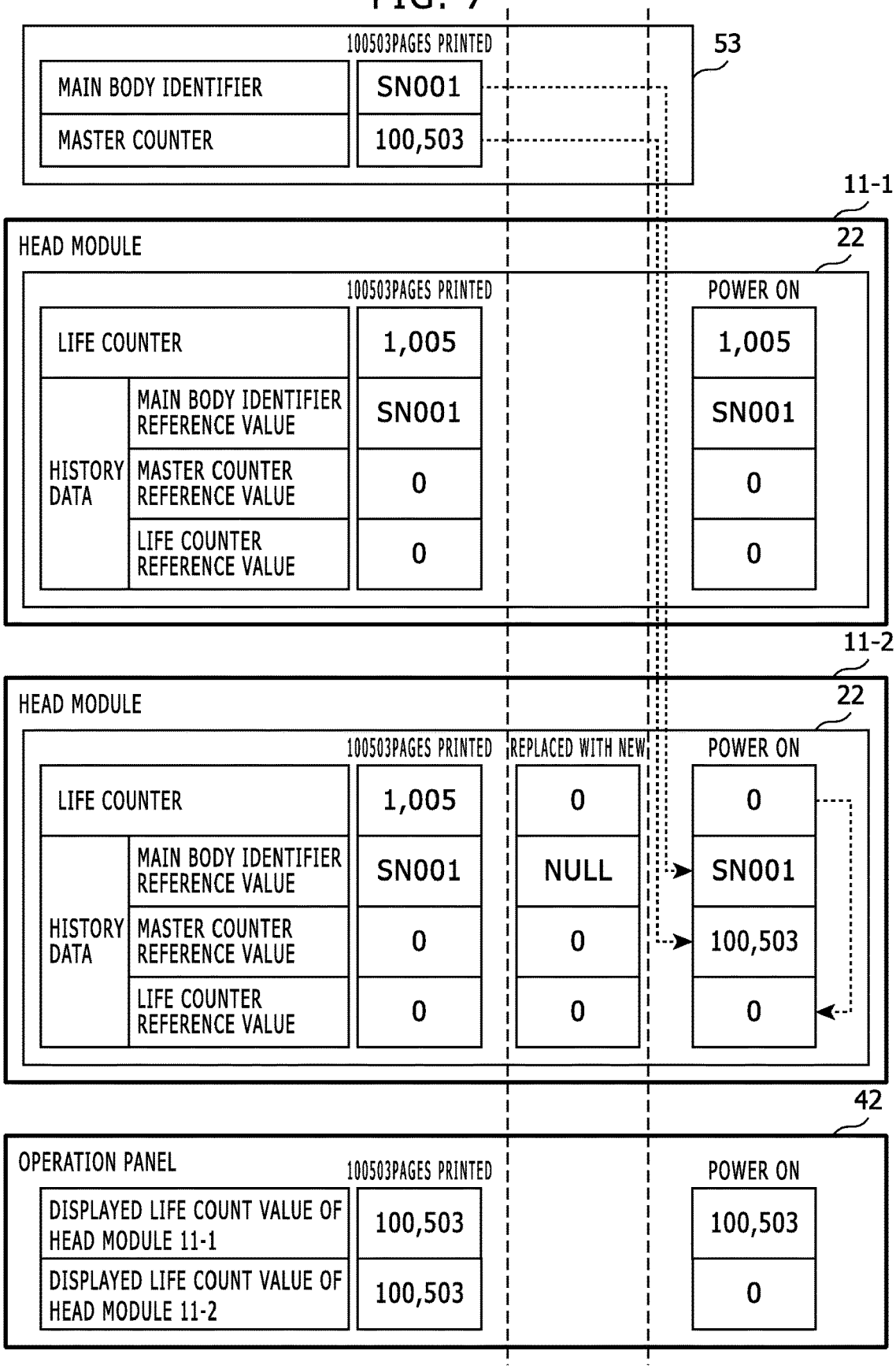
FIG. 7 shows a diagram that explains a behavior of the life counter management system shown in FIG. 3 when a head module 11-*i* is replaced with brand new one in a non initial state.
Figure 8:
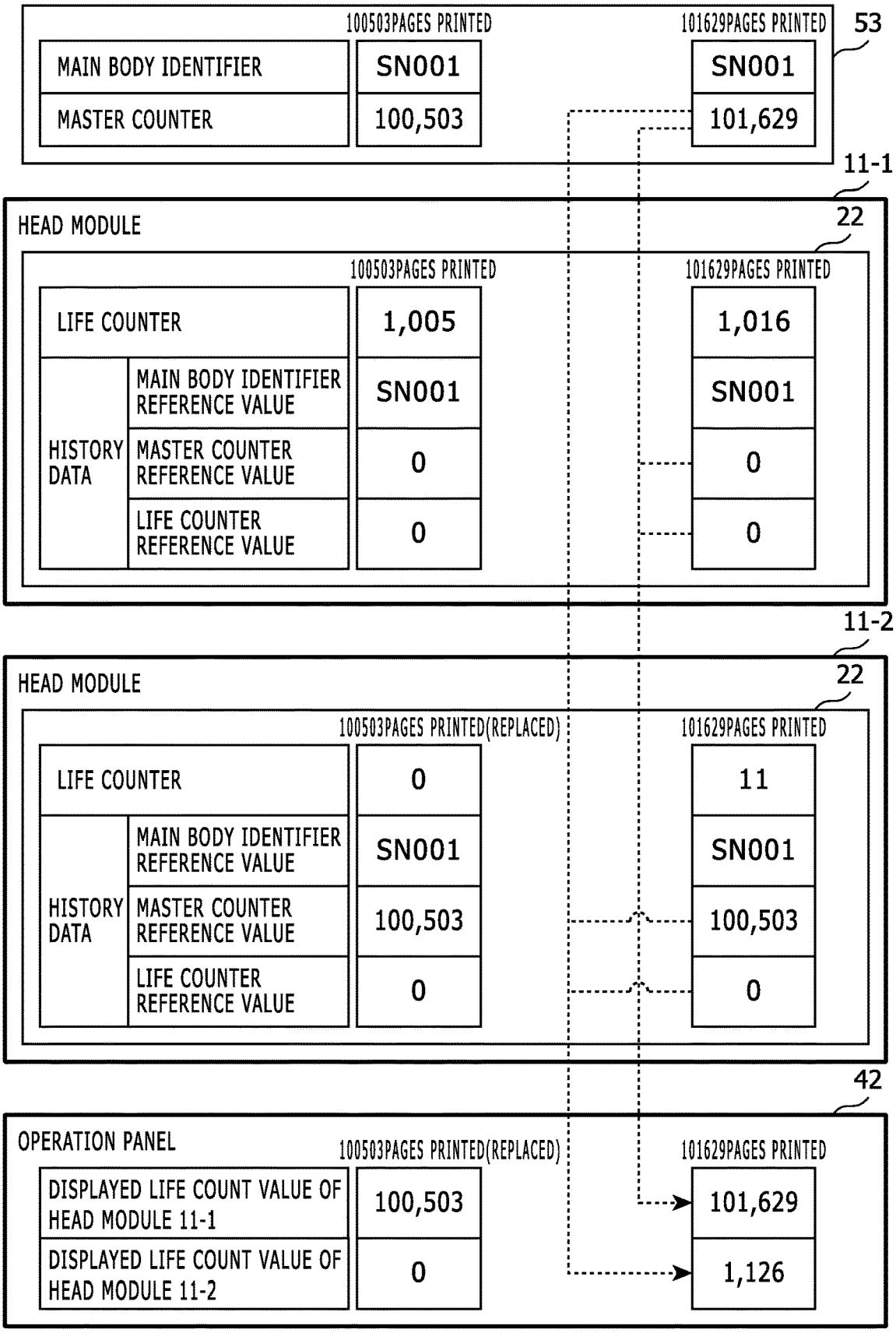
FIG. 8 shows a diagram that explains a behavior of the life counter management system shown in FIG. 3 after a head module 11-*i* is replaced with brand new one in a non initial state.

(c) When the Head Module 11-*i* is Replaced with New One in a Non Initial State This part explains a behavior of the life counter management system of this embodiment when the head module 11-*i* is replaced with new one after printing is performed after the aforementioned initial state. FIG. 7 shows a diagram that explains a behavior of the life counter management system shown in FIG. 3 when a head module 11-*i* is replaced with brand new one in a non initial state. FIG. 8 shows a diagram that explains a behavior of the life counter management system shown in FIG. 3 after a head module 11-*i* is replaced with brand new one in a non initial state.

In a state that the head module 11-*i* is brand new, the life counter and the history data stored in the local memory 22 of this head module 11-*i* have initial values as shown in FIG. 4.

When the main body 12 is powered on after the head module 11-*i* is replaced with new one, the life counter managing unit 51*a* renews the history data (the main body identifier reference value, the master counter reference value, and the life counter reference value) in the local memory 22 in the aforementioned manner when powered on because the main body identifier reference value in the local memory 22 and the main body identifier of the main body 12 do not agree with each other.

For example, as shown in FIG. 7, if the head module 11-2 is replaced with new one upon printing of 100503 pages, then when firstly powered on after the replacement, the history data in the local memory 22 of the head module 11-2 are renewed. Consequently, the displayed life count value of the head module 11-2 gets zero in accordance with Formula (2).

When printing of 1126 pages is additionally performed, as shown in FIG. 8, the master counter is incremented, and the life counter is incremented to 11 in accordance with Formula (1). Further, the displayed life count value of the head module 11-2 after the replacement gets 1,126 in accordance with Formula (2), and the displayed life count value of the head module 11-1 with no replacement gets 101,629 in accordance with Formula (2).

Figure 9:
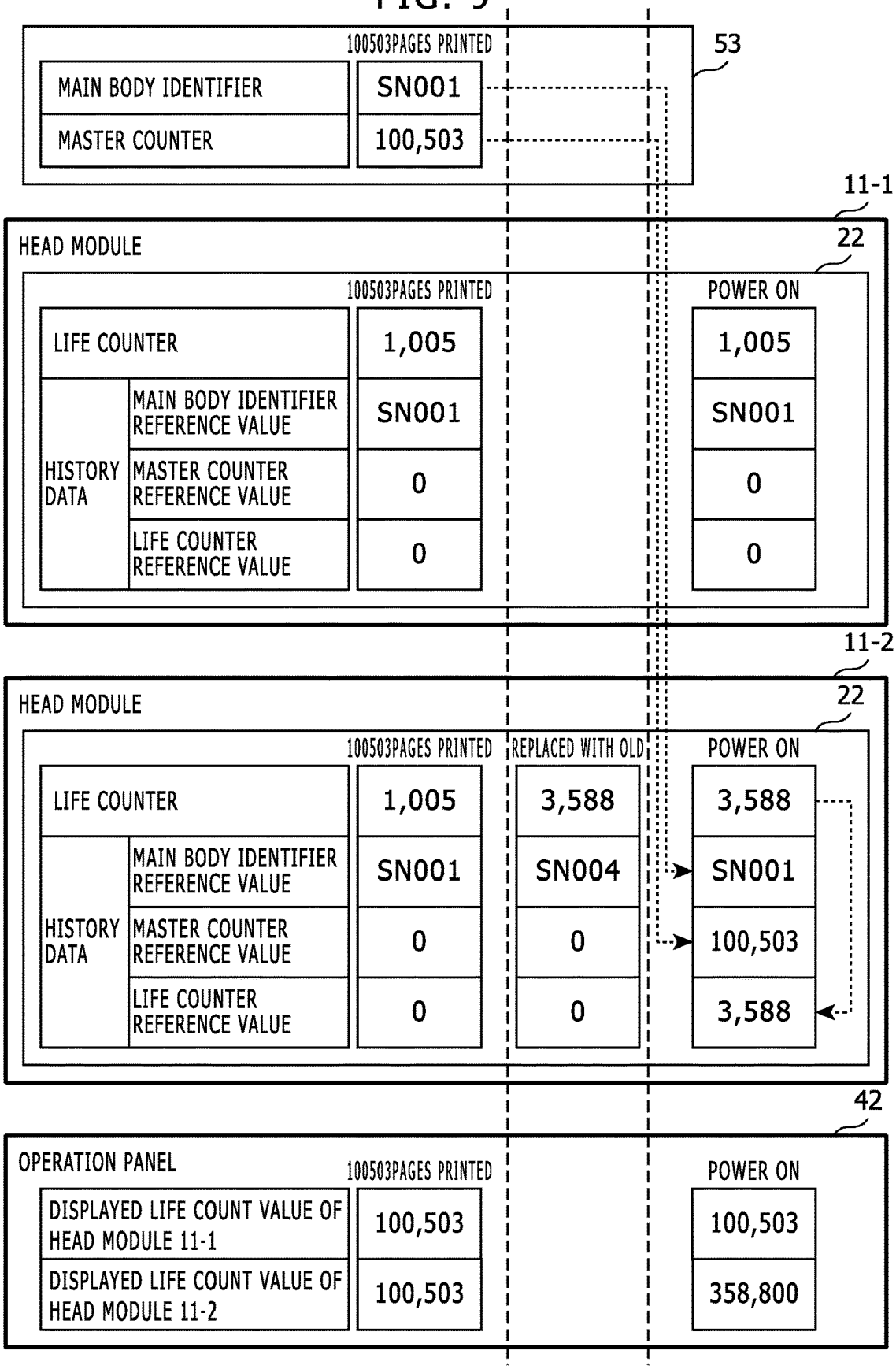
FIG. 9 shows a diagram that explains a behavior of the life counter management system shown in FIG. 3 when a head module 11-*i* is replaced with used one in a non initial state.
Figure 10:
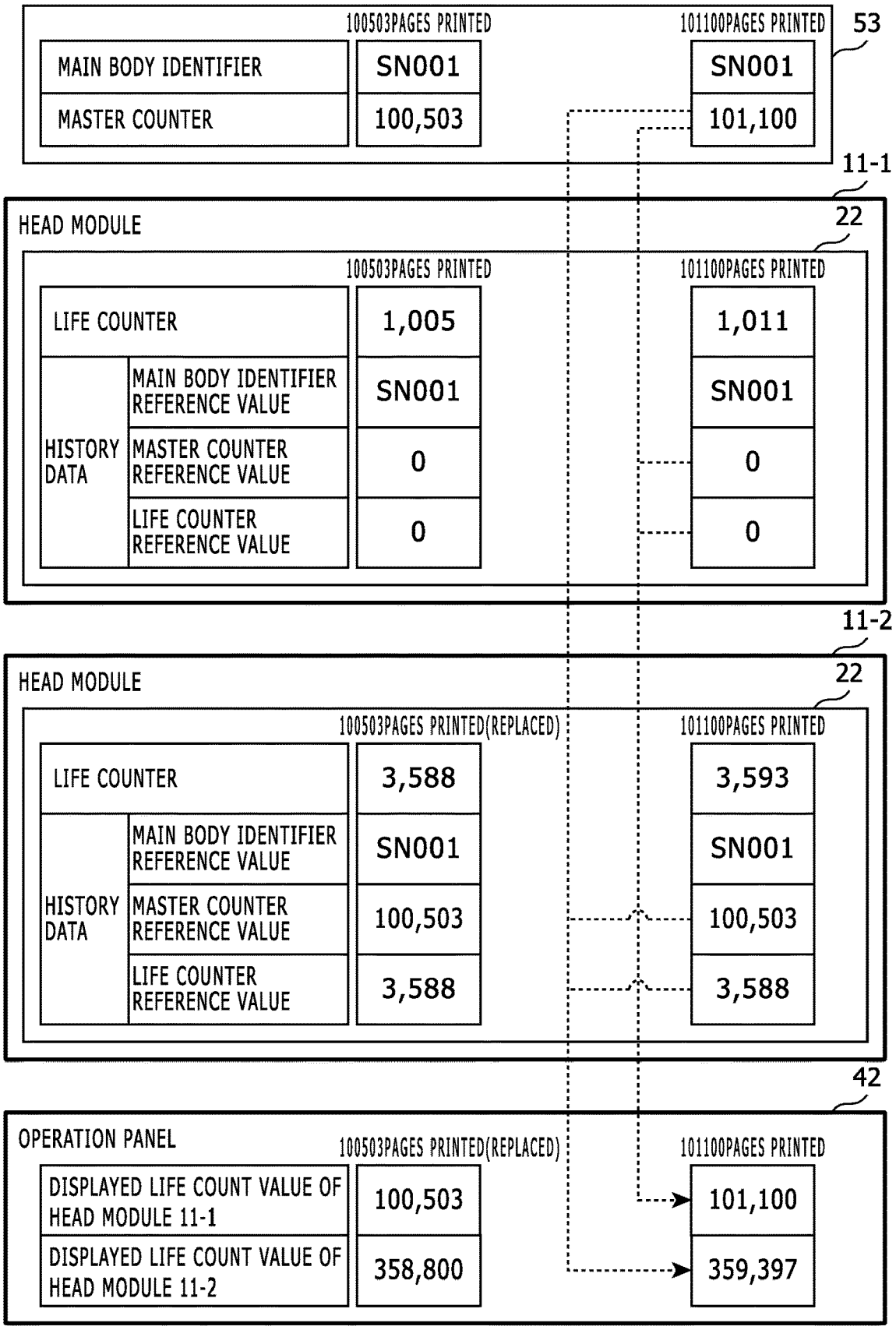
FIG. 10 shows a diagram that explains a behavior of the life counter management system shown in FIG. 3 after a head module 11-*i* is replaced with used one in a non initial state.

(d) When a Head Module 11-*i* is Replaced with Used One (i.e. a Head Module Product of which Usage has been Started) in a Non Initial State This part explains a behavior of the life counter management system of this embodiment when the head module 11-*i* is replaced with used one after printing is performed after the aforementioned initial state. FIG. 9 shows a diagram that explains a behavior of the life counter management system shown in FIG. 3 when a head module 11-*i* is replaced with used one in a non initial state. FIG. 10 shows a diagram that explains a behavior of the life counter management system shown in FIG. 3 after a head module 11-*i* is replaced with used one in a non initial state.

In a state that the usage of the head module 11-*i* has been started, the life counter and the history data stored in the local memory 22 of the head module 11-*i* are not the initial values as shown in FIG. 4, (a) the life counter has a count value of the life counter written by the main body 12 of which the apparatus used this head module 11-*i* until the current time point, (b) the main body identifier reference value keeps the main body identifier of the apparatus that used this head module 11-*i* until the current time point, and (c) the life counter reference value keeps a count value of the life counter at a time point that this head module 11-*i* was mounted to the apparatus that used this head module 11-*i* until the current time point.

When the main body 12 is powered on after the head module 11-*i* is replaced with used one, the life counter managing unit 51*a* renews the history data (the main body identifier reference value, the master counter reference value, and the life counter reference value) in the local memory 22 in the aforementioned manner when powered on because the main body identifier reference value in the local memory 22 and the main body identifier of the main body 12 do not agree with each other.

For example, as shown in FIG. 9, if the head module 11-2 is replaced with used one upon printing of 100503 pages, then when firstly powered on after the replacement, the history data in the local memory 22 of the head module 11-2 are renewed. In addition, the life counter reference value is renewed with a count value of the life counter of the used one. Consequently, the displayed life count value of the head module 11-2 gets 358,800 in accordance with Formula (2).

When printing of 597 pages is additionally performed, as shown in FIG. 10, the master counter is incremented, and the life counter is incremented from 3588 to 3593 in accordance with Formula (1). Further, the displayed life count value of the head module 11-2 after the replacement gets 359,397 in accordance with Formula (2), and the displayed life count value of the head module 11-1 with no replacement gets 101,100 in accordance with Formula (2).

(e) When Zero Clear is Requested of a Displayed Life Count Value of a Specific Head Module **11-*i***

Figure 11:
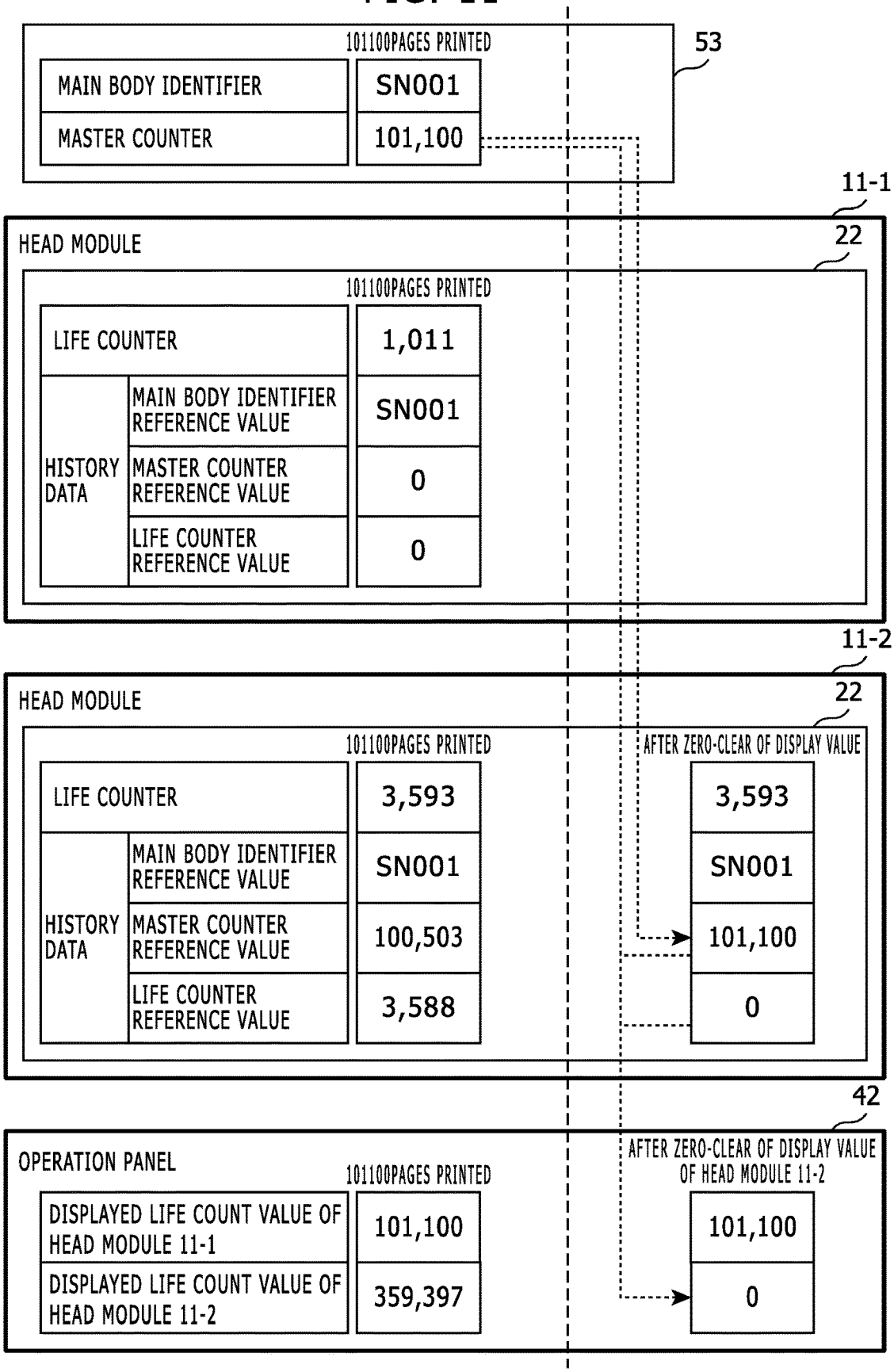
FIG. 11 shows a diagram that explains a behavior of the life counter management system shown in FIG. 3 when zero clear is requested for a displayed life count value of a specific head module 11-*i*.

FIG. 11 shows a diagram that explains a behavior of the life counter management system shown in FIG. 3 when zero clear is requested for a displayed life count value of a specific head module **11-*i***.

For example, if a user performs a predetermined user operation to the operation panel 42 for requesting zero clear of the displayed life count value of a specific head module **11-*i* (the head module 11-2 in FIG. 11), then the life counter managing unit 51*a* detects the user operation with the operation panel 42, and performs zero clear of the displayed life count value of the specific head module 11-*i*** specified by the user operation.

Specifically, upon receiving such zero clear request, the life counter managing unit **51*a* (a) writes a current count value of the master counter stored in the main body memory 53 of the main body 12 into the local memory 22 as the master counter reference value, and (b) resets the life counter reference value stored in the local memory 22 of this head module 11-*i* to zero. Consequently, the displayed life count value of the head module 11-2** after the zero clear gets zero in accordance with Formula (2).

As mentioned, the life counter management system in the aforementioned embodiment includes the main body 12 of each apparatus among plural apparatuses, and the head module **11-*i* as a replaceable unit capable of being mounted to and demounted from the main body 12. The main body 12 includes the main body memory 53 that is a non-volatile memory, and the life counter managing unit 51*a*. The head module 11-*i* includes the local memory 22 that is a non-volatile memory. Further, (a) when the head module 11-*i* is mounted to the main body 12, if a main body identifier reference value stored in the local memory 22 of the head module 11-*i* is different from a main body identifier of the main body 12 that the head module 11-*i* is mounted, the life counter managing unit 51*a* (a1) writes the main body identifier of the main body 12 into the local memory 22 of the head module 11-*i* as the main body identifier reference value, (a2) writes a life counter value stored in the main body memory 53 of the main body 12 into the local memory 22 as a master counter reference value, and (a3) writes a life counter value stored in the local memory 22 separately into the local memory 22 as a life counter reference value; (b) the life counter managing unit 51*a* counts up an action of the main body 12 and increments a life counter value in the main body memory 53 in accordance with the action; (c) the life counter managing unit 51*a* increments a life counter value in the local memory 22 in accordance with the action of the main body; and (d) the life counter managing unit 51*a* determines a life count value of the head module 11-*i* on the basis of (d1) a first difference between the current life counter value in the main body memory 53 and the master counter reference value in the local memory 22 and (d2) a second difference between the current life counter value in the local memory 22** and the life counter reference value.

Consequently, even if one head module **11-*i* is used in plural image forming apparatuses in turn, a life count value of the head module 11-*i*** is properly managed.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the life counter management system is applied to an inkjet image forming apparatus. Alternatively, the life counter management system may be applied to an electrographic image forming apparatus. In such a case, a life count value is managed of a photoconductor drum unit, a development unit, an intermediate transfer belt unit, a fuser unit or the like as the aforementioned replaceable unit. Further, the life counter management system may be applied to another type of an electronic apparatus.

Further, in the aforementioned embodiment, when the main body identifier reference value in the history data stored in the local memory 22 does not agree with the main body identifier and consequently the main body identifier reference value is renewed, the main body identifier reference value, the master counter reference value and the life counter reference value before the renewal may not be deleted nor overwritten but saved. Consequently, (a) an apparatus that the head module **11-*i*** was mounted in the past and (b) a count value at this apparatus can be determined on the basis of the aforementioned history data.

What is claimed is:

1. A life counter management system, comprising:

a main body of each apparatus among plural apparatuses; and a replaceable unit capable of being mounted to and demounted from the main body;

wherein the main body comprises a main body memory that is a non-volatile memory;

and a life counter managing unit;

the replaceable unit comprises a local memory that is a non-volatile memory;

(a) when the replaceable unit is mounted to the main body, if a main body identifier reference value stored in the local memory of the replaceable unit is different from a main body identifier of the main body that the replaceable unit is mounted, the life counter managing unit (a1) writes the main body identifier of the main body into the local memory of the replaceable unit as the main body identifier reference value, (a2) writes a life counter value stored in the main body memory of the main body into the local memory as a master counter reference value, and (a3) writes a life counter value stored in the local memory separately into the local memory as a life counter reference value;

(b) the life counter managing unit counts up an action of the main body and increments a life counter value in the main body memory in accordance with the action;

(c) the life counter managing unit increments a life counter value in the local memory in accordance with the action of the main body; and (d) the life counter managing unit determines a life count value of the replaceable unit on the basis of (d1) a first difference between the current life counter value in the main body memory and the master counter reference value and (d2) the life counter reference value.

2. The life counter management system according to claim 1 wherein the life counter managing unit (b) increments the life counter value in the main body memory by 1 for one time of a predetermined action of the main body, (c) increments the life counter value in the local memory by 1 for predetermined plural times of the predetermined action, and (d) determines the life count value of the replaceable unit on the basis of a sum of (d1) the first difference and (d2) a product of the life counter reference value and the predetermined plural times.

3. The life counter management system according to claim 1 wherein if the life counter managing unit receives a zero clear request for the replaceable unit, the life counter managing unit (a) writes the life counter value stored in the main body memory into the local memory as the master counter reference value, and (b) resets the life counter reference value stored in the local memory as zero.

4. The life counter management system according to claim 1 wherein the plural apparatuses are plural inkjet image forming apparatuses;

the replaceable unit is a head module in each of the plural inkjet image forming apparatuses; and the action is printing one page.

* * * * *